United States Patent [19]

Struzik et al.

[11] Patent Number: 4,783,060

[45] Date of Patent: Nov. 8, 1988

[54] IMMERSION LANCE

[75] Inventors: Erich Struzik, Solingen; Hans D. Hofmann, Neuwied; Dirk Stein, Höhr-Grenzhausen, all of Fed. Rep. of Germany

[73] Assignee: Plibrico Company GmbH, Düsseldorf, Fed. Rep. of Germany

[21] Appl. No.: 88,419

[22] Filed: Aug. 6, 1987

[30] Foreign Application Priority Data

Aug. 20, 1986 [DE] Fed. Rep. of Germany ... 8622299[U]
Jun. 13, 1987 [DE] Fed. Rep. of Germany ..... 3719862

[51] Int. Cl.[4] ..... C21C 5/48
[52] U.S. Cl. ..... 266/270; 266/225
[58] Field of Search ..... 266/225, 270, 218, 265

[56] References Cited

U.S. PATENT DOCUMENTS 3,833,209 9/1974 Chang ..... 266/225
3,976,286 8/1976 Thompson et al. ..... 266/225

FOREIGN PATENT DOCUMENTS 904670 4/1986 Belgium .
091127 10/1983 European Pat. Off. .
106822 4/1984 European Pat. Off. .
7613309 9/1976 Fed. Rep. of Germany .
2439700 7/1977 Fed. Rep. of Germany .
3322556 1/1985 Fed. Rep. of Germany .
27045 8/1973 Japan ..... 266/225
1206314 1/1986 U.S.S.R. ..... 266/270
2059559 4/1981 United Kingdom ..... 266/225

*Primary Examiner*—L. Dewayne Rutledge
*Assistant Examiner*—Robert L. McDowell
*Attorney, Agent, or Firm*—Michael J. Striker

[57] ABSTRACT

The invention relates to an immersion lance for the introduction of treatment media such as gases, more particularly inert gases and/or carrier gases by which solids such as slag-forming substances, carbon or the like are transported, into a vessel filled with liquid metal, more particularly for the treatment of pig iron or steel. The immersion lance comprises an inner metal tube for the supply of the medium and a refractory monolithic ceramic jacketing, which is supported by means of a reinforcement bearing against the inner tube, one or more outlet apertures being provided which penetrate the jacketing. The reinforcement bearing enclosing the inner tube is formed by at least one spirally coiled ribbed band forming rib members with uniform spacings and being connected to the inner rib.

10 Claims, 1 Drawing Sheet

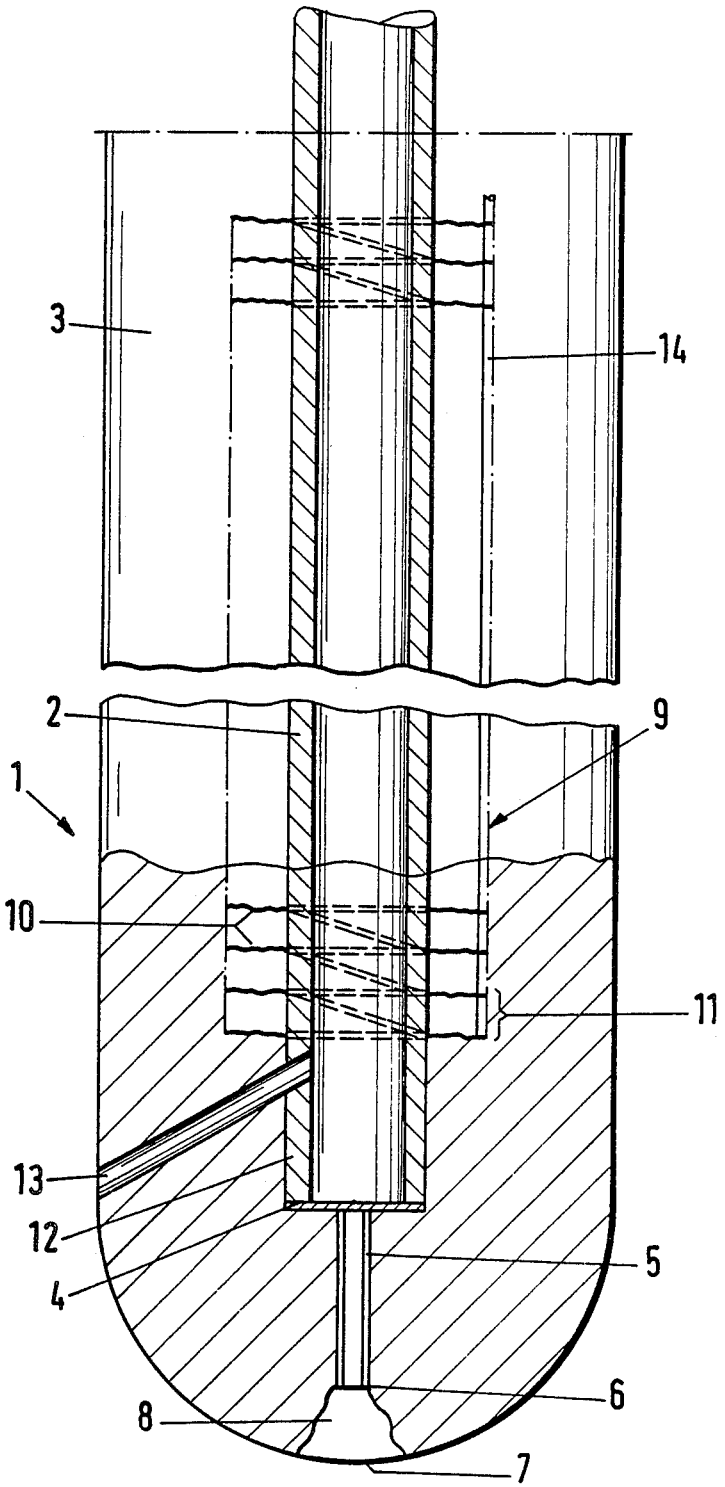
3
14
2
9
1
10
11
13
12
4
5
6
8
7

IMMERSION LANCE

BACKGROUND OF THE INVENTION

Many forms of immersion lances are known and used for the mixing, degassing or desulphurization of steel melts. The lances must be designed in such a manner that they withstand the considerable stressings which occur during the blowing operation due to the actual temperature and the change in temperature, erosional attack by the metal and the slag, chemical processes and mechanical stressing due to the static and dynamic mechanical forces in the form of buoyancy and vibrations.

It is an object of the invention to provide an immersion lance whose heat-dissipating surface is increased to a substantial extent, so that the thermal stressing of the refractory material is substantially lower, the result being an extended service life. Further objects of the invention are to substantially enhance the moment of resistence of the whole lance and to obviate the effect of destructive oscillations on the lance.

SUMMARY OF THE INVENTION

The invention relates to an immersion lance for the introduction of treatment media such as gases, more particularly inert gases and/or carrier gases by which solids such as slag-forming substances, carbon or the like are transported into a vessel filled with liquid metal, more particularly for the treatment of pig iron or steel. The immersion lance comprises an inner metal tube for the supply of the medium and a refractory monolithic ceramic jacketing, which is supported by means of a reinforcement bearing against the inner tube, one or more outlet apertures being provided which penetrate the jacketing. The reinforcement bearing enclosing the inner tube is formed by at least one spirally coiled ribbed band forming rib members with uniform spacings and being connected to the inner tube.

The increase in the size of the heat-dissipating surface achieved by the spiral band of ribs around the inner tube appreciably improves the cooling effect of the flushing gas, thus obviating brief overheatings and cloggings inside the lance, whose stability is at the same time enhanced.

Preferably the rib member are at right angles to the longitudinal axis of the inner tube, thus ensuring the highest possible stability. The same purpose is served by adapting the spacing between adjacent rib windings to 1/6 to 3/6 of the internal diameter of the inner tube.

The ribbed band may extend over substantially the whole of the length of the inner tube covered by the jacketing, to achieve optimum heat dissipation.

The invention can be applied to all immersion lances with any design, position and arrangement of the outlet apertures. However, in one advantageous embodiment the lower end of the inner tube is closed with a thin sheet metal disc adjoined by an outlet tube whose diameter is smaller than the diameter of the inner tube. The lower end of the outlet tube terminates before the lowest point of the jacketing. A central head member of a refractory material which can very simply be removed is also inserted in the lowest zone of the jacketing between the lowest point and the lower end of the outlet tube.

An embodiment of an immersion lance having the features claimed will now be described in detail with reference to the drawing.

BRIEF DESCRIPTION OF THE DRAWING

The single FIGURE of the drawings is a view showing a cross-section of the inventive immersion lance.

DESCRIPTION OF A PREFERRED EMBODIMENT

An immersion lance 1, has an inner metal tube 2 and a refractory monolithic jacketing 3. The lower end of the inner tube 2 is closed by a thin sheet metal disc 4 adjoined by an an outlet tube 5. A head member 8 of refractory material which can easily be broken away is disposed between the lower end 6 of the outlet 5 and the lowest point 7 of the jacketing 3.

At its lower end 12 the inner tube 2 is connected to atmosphere via one or more lateral channels 13 in the jacketing 3. When the lance is immersed, any gases charged with solids from the inner tube 2 pass via the channel or channels 13 into the metal melt. If one or more of the channels 13 is clogged with slag or metal residues, the head member 8 is broken away and the sheet metal disc 4 penetrated, thus providing the inner tube 2 with a further outlet which can readily be created.

The inner tube 2 is enclosed by ribbed band 9 spirally wound such that the rib members 10 are formed with uniform spacings 11 in the axial direction of the lance.

As the drawing shows, the rib members 10 have first outer portions which are at right angles to the longitudinal axis of the inner tube 2. The rib members are corrugated. As a result, the heat-dissipating surface is increased.

The width of the outer portions in the radial direction is many times greater than their thickness in the axial direction.

The rib members 10 also have second inner portions which are spirally inclined to the inner tube 2 and bear against the latter. The outer portions and the inner portions of all rib members together form the ribbed band 9.

Stability is enhanced by one or more rods 14 applied, for example, by welding or soldering on the outer periphery of the band of ribs 9 extending parallel with the axis of the inner tube. A number of rods 14 can enclose the band of ribs 9 like a cage.

We claim:

1. An immersion lance for the introduction of treatment media into a vessel filled with liquid metal, comprising:

an inner tube for supplying the medium and extending longitudinally in an axial direction;

a refractory monolithic ceramic jacketing; and means for retaining said jacketing, said retaining means including a reinforcement element with at least one ribbed band spirally wound around and against said inner tube, said ribbed band having rib members extending outward in a radial direction so as to define a width that is a plurality of times wider than said rib members are thick in said axial direction, said rib members having first portions extending transversely with respect to said inner tube so as to have uniform spacings between said rib members, said rib members also having second portions spirally inclined between said first portions and which bear against said inner tube, said ribbed band being connected to said inner tube.

2. An immersion lance according to claim 1 wherein said ribbed band is wound such that the spacings between adjacent rib windings are 1/6 to 3/6 of an internal diameter of the inner tube.

3. An immersion lance according to claim 1, wherein said ribbed band extends over substantially a whole length of the inner tube which is covered by the jacketing.

4. An immersion lance according to claim 1, wherein said rib members are corrugated.

5. An immersion lance according to claim 1, wherein said rib members are interconnected via at least one rod extending parallel to an axis of an inner metal tube.

6. An immersion lance according to claim 5, wherein at least two rods are disposed spaced-out and distributed on a periphery of the ribbed band.

7. An immersion lance according to claim 1, wherein said first portions of said rib members lie in parallel planes that are substantially perpendicular to an axis of said inner tube.

8. An immersion lance according to claim 1, wherein all of said reinforcement element bears against said inner tube.

9. An immersion lance according to claim 1, wherein said jacketing has at least one outlet aperture penetrating said jacketing.

10. An immersion lance according to claim 9, wherein said inner tube has a diameter, said jacketing having a lower portion; further comprising:

a sheet metal disc closing said lower end of said tube and being adjoined by an outlet tube, said outlet tube having a diameter smaller than the diameter of the inner tube, said outlet tube having a lower end terminating before the lower portion of the jacketing; and a central head member composed of a refractory material removably inserted in the lower portion of the jacketing and the lower end of the outlet tube.

* * * * *